United States Patent [19]

Lipets et al.

[11] 4,089,369

[45] May 16, 1978

[54] MODULAR HEAT EXCHANGER AND METHOD OF ITS OPERATION

[76] Inventors: Adolf Usherovich Lipets, prospekt Lenina, 150-a, kv. 38; Viktor Fedorovich Moskvichev, ulitsa Entuziastov, 10, kv. 9; Georgy Viktorovich Katyshev, ulitsa Entuziastov, 16, kv. 13; Lev Nikolaevich Artemov, ulitsa Pravdy, 24A, kv. 44; Anatoly Fedorovich Bakanov, ulitsa Ordzhonikidze, 13, kv. 40; Raisa Nikiforovna Shamarokova, Gulevsky proezd, 8/5, kv. 60; Alexei Arsentievich Dolgy, Revprospekt, 16, kv. 23; Stanislav Alexandrovich Eletsky, ulitsa Mashinostroitelei, 28, kv. 75; Yakov Natanovich Grinberg, ulitsa Entuziatsov, 3, kv. 28; Vitaly Andreevich Ardamatsky, Gulevsky proezd, 6, kv. 5; Svyatoslav Nikolaevich Vivsik, Bolnichny proezd, 3, kv. 56, all of Podolsk Moskovskoi oblasti; Vasily Evdokimovich Zavedeev, poselok Sosny, 7, kv. 75, Minsk; Ilya Julievich Zevin, ulitsa Fevralskaya, 54/150, kv. 80, Podolsk Moskovskoi oblasti; Evgeny Alexeevich Fadeev, ulitsa Sevanskaya, 7, korpus 1, kv. 64, Moscow, all of U.S.S.R.

[21] Appl. No.: 674,093

[22] Filed: Apr. 6, 1976

[51] Int. Cl.[2] ..... F28F 9/02

[52] U.S. Cl. ..... 165/158; 176/65

[58] Field of Search ..... 176/65; 165/158–162; 122/32, 34

[56] References Cited

U.S. PATENT DOCUMENTS

| | | | |
|---|---|---|---|
| 3,134,432 | 5/1964 | Means | 165/158 |
| 3,228,463 | 1/1966 | Kagi | 165/158 |

FOREIGN PATENT DOCUMENTS

| | | | |
|---|---|---|---|
| 1,066,972 | 9/1967 | United Kingdom | 122/32 |

*Primary Examiner*—Charles J. Myhre
*Assistant Examiner*—Theophil W. Streule, Jr.
*Attorney, Agent, or Firm*—Haseltine, Lake & Waters

[57] ABSTRACT

A modular heat exchanger comprises modules connected in parallel. Each module represents by itself a casing inside of which there is provided a bundle of straight pipes for the first coolant; the open ends of the straight pipes adjoin tube plates. The latter are secured on the casing which has an inlet and outlet for the second coolant coming into contact with the intertube space. The modules are arranged in a shell for a first coolant, to pass therethrough which is fed into the straight pipes and the space between said modules. The shell is provided with an inlet and outlet for the second coolant. Displacers are arranged in the space between the modules, over the entire length of the latter, which displacers ensure equality of the heat-exchange coefficient inside the straight pipes and between the modules. The method of the operation of the modular heat exchanger is as follows: The first coolant is fed into the straight pipes of the module and into the shell, which coolant comes into contact, correspondingly, with the inner surface of the straight pipes and the outer surface of the modules' casings; the second coolant is fed into the inter-tube space of the module, which coolant comes into contact with the outer surface of the pipes and the inner surface of the casing of the module.

4 Claims, 3 Drawing Figures

MODULAR HEAT EXCHANGER AND METHOD OF ITS OPERATION

FIELD OF THE INVENTION

The present invention relates to heat-exchanging devices and more specifically to modular heat exchangers.

This invention can be successfully used in the power, chemical, petrochemical, food and other industries for heating or cooling of water, steam, gas and various chemical media in a liquid, vaporous and gaseous state. It can be most successfully realized in condensing one of the coolants and heating the other, specifically, in intermediate steam superheaters of atomic power plants.

DESCRIPTION OF THE PRIOR ART

Known in the art is a recuperative heat exchanger, comprising a bundle of straight pipes forming the heating surface, which bundle is arranged in a casing. The open ends of the pipes adjoin tube plates which are secured on the casing. The tube plates, closed by spherical caps, form inlet and outlet headers for a coolant, coming into contact with the inner surface of the pipes. Sleeves for feeding and discharging the second coolant, which comes into contact with the inter-tube space of the heat exchanger, are mounted on the casing, in a zone of the tube plates. The inlet header is provided with a sleeve through which the first coolant is fed into the pipes, wherein heat exchange takes place, the first coolant being discharged from the pipes through a sleeve mounted on the outlet header.

The second coolant is fed into the inter-tube space through an inlet sleeve mounted on the casing in a zone of one tube plate, in which casing heat exchange takes place; then this coolant is discharged through an outlet sleeve mounted on the casing in the zone of the other tube plate. In such a case, the coolants chiefly move in a single-pass flow.

Heat exchangers of such a design are used very seldom, as in specific operational conditions a number of additional demands are required of them the fulfilment of which leads to a complicated design of the heat exchanger.

First, in operation of the heat exchangers where there occurs a big temperature difference of the coolants, high thermal stresses arise because of different temperature deformations of the pipes and of the casing, which makes it necessary to arrange a compensating facility in the heat exchanger.

Second, in case of small heat exchangers the diameter of the casing of which is less than 1 m, repairs of damaged pipes are impeded, as it is necessary to cut off a spherical cap for the purpose, which makes repair work a more labour-consuming process.

In case of big heat exchangers the diameter of the casing of which is more than one meter, detection of microleakages in the place where the open ends of the pipes adjoin the tube plates is made more difficult because of a big number of the straight pipes. This is especially substantial in transferring heat from the first circuit to the second one in case of atomic power plants.

Third, an increase in the dimensions of the heat exchanger leads to a longer period for its manufacture, mainly due to high labour consumption in making the tube plates, especially in case of high pressures of a coolant, as the thickness of the tube plates increases substantially.

And, finally, in big heat exchangers the diameter of the bundle of pipes of which is more than one metre, there is observed essential non-uniformity of the distribution of a coolant in the inter-tube space along its section, because of a side inlet and outlet for the coolant, which reduces the amount of heat removed from the surface of heating per unit of time, i.e., reduces the rate of heat transfer from the outer surface of the pipes to the coolant, as a result of which in order, to compensate the heat losses, it is necessary to increase the surface of heating, this resulting in a higher metal consumption of the heat exchanger.

The greatest diversity of design schemes of heat exchangers has been caused by the attempts to solve the question of compensating for the temperature deformations of the pipes and the casing.

Known in the art is a heat exchanger which has a design similar to that mentioned above, which design provides for a compensator of thermal stresses. Such a heat exchanger can be employed only when using in the inter-tube space a coolant of low pressure.

Also, known in the art is a heat exchanger, in which temperature deformations are compensated with the help of a "floating head."

The disadvantage of such a heat exchanger is its considerable metal consumption and high labour consumption, caused by the manufacture of the "floating head" and by the need of its periodic inspection and repair in operation.

Still another method has been proposed for elimination of temperature deformation of a casing and pipes in heat exchanges by appropriate selection of materials for said casing and pipes. However, such an embodiment of heat exchangers demands a wide choice of structural materials. Such a solution was applied in manufacturing steam generators in atomic units.

Known in the art is a heat exchanger, in which temperature expansions have been eliminated through the use of field pipes. The latter, however, substantially complicate a design and require almost a double consumption of metal in relation to the surface of heating.

Besides, known in the art, is a heat exchanger of the shell-and-pipe type, in which the questions of compensating the temperature deformations, simplifying the technology of manufacture and of compactness have been successfully solved.

In operation of the heat exchanger in inadequate and nonuniform contact of the surfaces of heating by the coolant, passing through the inter-tube space, is still observed, because of enlarged gaps between the bundles, caused by the technology of assembling the heat exchanger, and because of stagnant zones, formed by the flow of the coolant running against the spherical caps of the bundles of the pipes.

Also known in the art is a modular exchanger, which comprises modules connected in parallel and which modules communicate with a header.

Each module represents by itself a heat exchanger, comprising a casing inside of which there is arranged a bundle of straight pipes for the first coolant. The open ends of the pipes adjoin tube plates. The latter are secured on the casing. One of the tube plates, from the side of the open ends of the pipes, is closed by a spherical cap, which has mounted on it a sleeve for feeding of the first coolant. The second tube plate, also from the side of the open ends of the pipes, is closed by a spherical cap which has mounted on it a sleeve for discharging the first coolant. The tube plates, closed from the side of the open ends of the pipes by the spherical caps with the sleeves, form inlet and outlet chambers for the first coolant.

In operation of the modular heat exchanger, the first coolant is fed into the inlet header wherefrom it passes, over pipings through the inlet sleeves, into the inlet chambers and then into the pipes of the bundle; simultaneously the second coolant is fed into its inlet header wherefrom it passes, over pipings through the inlet sleeves, into the inter-tube space. Heat exchange takes place between the first and second coolants, following which the first and second coolants flow, correspondingly, into the outlet coolants.

In the former modular heat exchanger the problems have been solved of compensating the temperature deformations of the pipes and casing, of making repairs of the heat exchanger easier, through disconnecting a damaged module, of simplifying the technology of manufacturing the modules, through manufacturing them by a flow-line production method, and also of making heat exchangers of any capacity, through selecting the modules without changes in their design.

SUMMARY OF THE INVENTION

The object of the present invention is to provide for a compact and simple in design modular heat exchanger.

Another object of the present invention is to diminish the temperature deformation of the pipes of the module and casing.

In accordance with the above-mentioned and other objects, the essence of the present invention is that in a modular heat exchanger, which comprises modules connected in parallel, wherein each module represents by itself a casing inside of which there is arranged a bundle of straight pipes for the first coolant, which pipes are adjacent at their open ends, tube plates secured on the casing, which casing has an inlet and outlet for the second coolant, the first coolant coming into contact with the inter-tube space, shell for passage therethrough of the first coolant, fed into the straight pipes and into the space between the modules; the shell is provided with an inlet and outlet for the second coolant; in such a case, in the space between the modules, over the entire length of the latter, there are arranged displacers ensuring the equality of heat-exchange coefficient inside the straight pipes and between the modules.

These and other objects are also achieved by a method of the operation of the modular heat exchanger, wherein the first coolant is fed into the straight pipes of each of the modules, which coolant comes into contact with their inner surface; the second coolant is fed into the inter-tube space of each module, which second coolant comes into contact with the outer surface of the pipes and the inner surface of the casing of each module, wherein, according to the invention, the first coolant is fed into the shell, which coolant comes into contact with the outer surface of the casings of the modules.

Such an embodiment of the modular heat exchanger and its method of operation diminish or even completely preclude the appearance of thermal stresses in the pipes and casings of the modules, caused by irregular temperature deformations, through levelling the temperature field of the pipes and of the casing of the modules, which levelling is achieved by feeding the same coolant into the pipes of the modules and into the space between said modules.

This makes it possible to discard the spherical cap on the casing of the module, as a result of which detection and repair of a damaged module are made considerably easier. Besides,the absence of the spherical caps enhances the compactness of the arrangement of the modules in the heat exchanger, diminishes the stagnant zones in the area of the tube plates of the module, which zones reduce the heat removal from the surface of heating, and reduce the metal consumption of the heat exchanger.

It is expedient that an inlet for the second coolant into the inter-tube space of each module be provided in one of the tube plates and an outlet in the other. The inlet and outlet of the second coolant should be disposed opposite each other and a displacer be mounted between them. This ensures a uniform distribution of the second coolant in the inter-tube space of the module.

It is recommended that feeding and discharging of the second coolant be accomplished through additional tube plates arranged on the casing and positioned at the opposite sides of the modules, and in which tube plates there are secured the open ends of pipes for feeding and discharging of the second coolant into the inter-tube space of each said module.

Such an embodiment of the heat exchanger considerably simplifies its repairs through disconnecting a damaged module, without penetrating into the inner space of the shell, which is especially important in case of the operation of the heat exchanger in the first circuit of atomic power plants. Besides, bent pipes are used for discharging and feeding of the second coolant into the inter-tube space of the modules, this resulting in ensuring the compensation of the temperature deformations of the modules and the shell of the heat exchanger, which factor makes it possible to dispense with a compensator on the casing of the heat exchanger, as a result of which labour consumption for its manufacture diminishes.

BRIEF DESCRIPTION OF THE DRAWINGS

Other aspects and advantages of the invention will be more clear from the following example of its embodiment and from the accompanying drawings, in which FIG. 1. schematically shows the modular heat exchanger, according to the invention, in a longitudinal section.

DESCRIPTION OF THE PREFERRED EMBODIMENT

Figure 1:
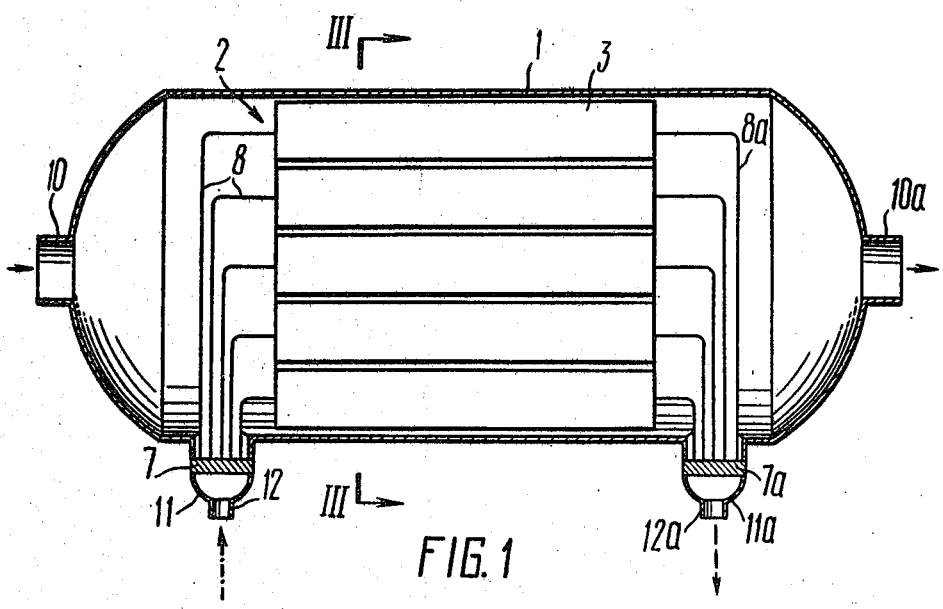

The modular heat exchanger comprises a shell 1 (FIG. 1), for passage of the first coolant; the shell has arranged in it modules 2, which modules are connected in parallel. Each module 2 represents by itself a casing 3, inside of which there is provided a bundle of straight pipes 4 (FIG. 2), for passage of the first coolant. The first coolant is shown by a solid arrow, and the second coolant — by a dash-and-dotted arrow. The open ends of the pipes 4 are secured in tube plates 5 and 5*a*, which plates, in their turn, are secured on the casing 3.

Figure 3:
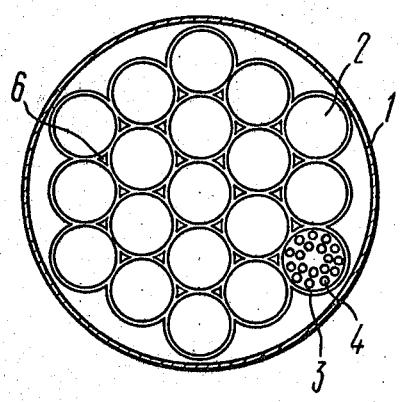
FIG. 3 shows section III—III of FIG. 1.
Figure 2:
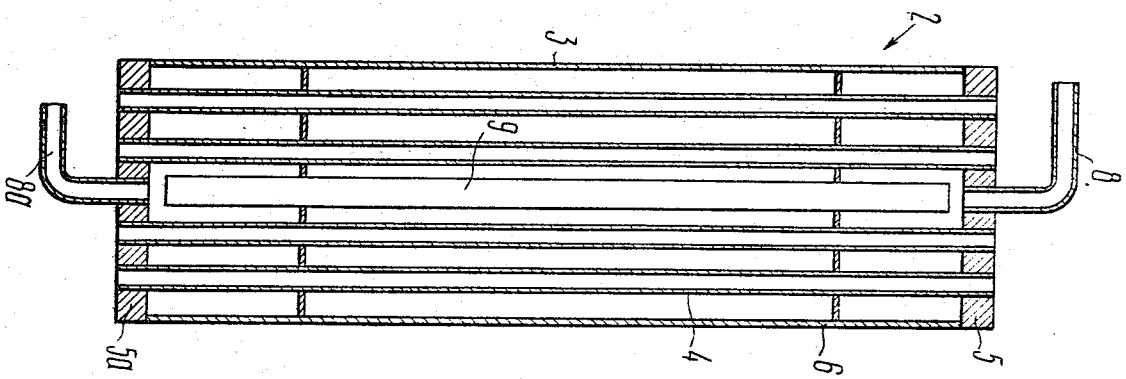
FIG. 2 shows the module, according to the invention, on an enlarged scale, in a longitudinal section.

An inlet for the second coolant, coming into contact with the inter-tube space of the module, is provided in one tube plate 5, and its outlet — in the other tube plate 5*a*. In the space between the modules 2, over the entire length of the latter, there are arranged displacers 6 (FIG. 3), which ensure equality of the heat-exchange coeffocient inside the straight pipes 4 and between the modules 2. The shell 1 has mounted on it additional tube plates 7, 7*a* (FIG. 1), which are arranged at the opposite sides of the modules 2. Feeding of the second coolant into the inter-tube space of each module 2 is accomplished with the help of pipes 8, the open ends of which are secured in the additional tube plate 7 and the tube plates 5 (FIG. 2). Discharging of the second coolant from the inter-tube space of each module is accomplished through pipes 8*a* (FIG. 1), the open ends of which are secured in the additional tube plate 7*a* and the tube plates 5*a* (FIG. 2). The inlet and outlet of the second coolant into the module 2 are provided, correspondingly, in the tube plates 5, 5*a*; the inlet and outlet are positioned one oposite the other, and between them there is arranged a displacer 9, which ensures uniform distribution of the second coolant in the intertube space of the module 2. If a condensing medium is used as the second coolant, there is no need to use the displacer 9. The shell 1 (FIG. 1) comprises a sleeve 10 for feeding of the first coolant into the space between the modules and into the straight pipes 4 (FIG. 2) of each the module 2, and a sleeve 10A (FIG. 1) for discharge of the first coolant. The additional tube plates 7, 7*a* are closed, correspondingly, by spherical caps 11, and 11*a*. To feed the second coolant the spherical cap 11 has arranged on it a sleeve 12, and a sleeve 12*a* is arranged on the spherical cap 11*a* to discharge the coolant.

The method of operation of the heat exchanger is as follows.

The first coolant, for example, steam of low pressure is fed, through the sleeve 10, into the shell 1, wherefrom it passes to the straight pipes 4 of each module 2 and into the space between the modules where comes into contact with the outer surface of the casing 3 and the inner surface of the pipes 4 of the modules 2. The second coolant, for example, steam of high pressure, is fed, through the sleeve 12, into the inter-tube space of the modules 2 over pipes 8, and which coolant comes into contact with the outer surface of the pipes 4 and the inner surface of the casing 3 of the modules 2. Superheating of the low-pressure steam takes place. Then the superheated low-pressure steam is discharged from the pipes 4 and from the space between the modules through the sleeve 10*a*. The condensed high-pressure steam is discharged from the inter-tube space of each module 2 over the pipes 8*a* through the sleeve 12*a*. The displacers 6 (FIG. 3) ensure the necessary correlation of consumption of the low-pressure steam inside the straight pipes 4 and between the casings 3 of the modules 2, which correlation results in evening up the temperatures of the surface of the pipes 4 and the casing 3.

As a result, the modules 2 do not require any devices, compensating any temperature deformations, and therefore can be made from straight pipes for any temperatures of their coolant, which greatly simplifies the design of the heat exchanger. The quality of manufacture of the modules can be very high, as all connections are accessible for a final control.

In the process of operation of the heat exchanger any leakage in the headers can be easily detected. For this purpose, the shell 1 is put under pressure and faulty module 2 is detected (if it is necessary the module is dampened), then the faulty module 2 is put under pressure and the faulty pipe 4 (FIG. 2) is detected, which pipe 4 is dampened in the tube plate 5. Thus, the open tube plates 5 and their accessibility are a rather important advantage of the herein-proposed heat exchanger.

What we claim is:

1. A modular heat exchanger comprising:

a shell formed with a first inlet and a first outlet for receiving and discharging a first coolant, respectively;

a plurality of longitudinal modules connected in parallel and disposed in said shell, each of said modules having the form of a casing, said module having opposite ends;

first and second plates secured to the module ends, respectively;

a plurality of longitudinal pipes disposed in each of said modules for receiving the first coolant, each of said pipes having first and second open ends, said plates being formed with openings for receiving the tube ends, respectively, said shell being formed with a second inlet and a second outlet for receiving and discharging a second coolant, respectively, each of said modules being formed with a third inlet and a third outlet, respectively, said third inlets and outlets communicating with said second inlets and outlets, respectively;

each of said modules being formed with an intertube space for the second coolant to pass therethrough; and a plurality of longitudinal displacer elements disposed in said shell said modules having a plurality of spaces defined therebetween, respectively, said displacer elements being disposed in said spaces alongside the entire length of the modules, whereby an equality of heat exchange between said modules is obtained.

2. A modular heat exchanger according to claim 1, wherein said third inlet is formed in one of the module ends and said third outlet is formed in the other of the module ends, said inlet and outlet being disposed opposite each other and a displacer being mounted between them.

3. A modular heat exchanger according to claim 1 further comprising third and fourth plates formed with openings and disposed in the vicinity of said second inlets and outlets, respectively, and wherein said third outlets are pipes, said third and fourth plates being formed with openings for receiving said pipes, respectively.

4. A modular heat exchanger according to claim 3, wherein said second inlets and outlets comprise spherical caps, respectively, each of said spherical caps comprising a sleeve.

* * * * *